US009320329B2

(12) United States Patent
Nisguretsky

(10) Patent No.: US 9,320,329 B2
(45) Date of Patent: Apr. 26, 2016

(54) IRREGULAR FINGER RING CONFIGURATION

(76) Inventor: Barry Nisguretsky, Brooklyn, NY (US)

( * ) Notice: Subject to any disclaimer, the term of this patent is extended or adjusted under 35 U.S.C. 154(b) by 0 days.

(21) Appl. No.: 11/623,433

(22) Filed: Jan. 16, 2007

(65) Prior Publication Data

US 2008/0168800 A1 Jul. 17, 2008

(51) Int. Cl.
*A44C 9/00* (2006.01)

(52) U.S. Cl.
CPC ..... *A44C 9/00* (2013.01); *A44C 9/0053* (2013.01)

(58) Field of Classification Search
CPC ..... A44C 9/00; A44C 9/0053; A44C 7/002; A44C 9/02
USPC ..... 63/15, 26–32 TS, 3, 15.45, 15.5, 15.6, 63/15.65, 15.7, 5.1, 11, 15.8, 15.9, 26–28, 63/29.1, 30; D11/34, 38, 37, 23, 35, 43, D11/47, 75–76, 79; 24/3, 15, 15.45, 15.5, 24/15.6, 15.65, 15.7
See application file for complete search history.

(56) References Cited

U.S. PATENT DOCUMENTS

| | | | | | |
|---|---|---|---|---|---|
| D15,489 | S | * | 10/1884 | Heer | D8/368 |
| 802,267 | A | | 10/1905 | Chaument | |
| 1,115,764 | A | * | 11/1914 | Applas | 63/15.6 |
| 1,146,543 | A | * | 7/1915 | Abel et al. | 63/15 |
| D68,149 | S | * | 9/1925 | Lindeberg | D11/38 |
| 1,668,217 | A | * | 5/1928 | Schraysshuen | 63/3 |
| 1,822,392 | A | * | 9/1931 | Esterman et al. | 63/15.4 |
| D96,056 | S | * | 6/1935 | Sasger | D11/38 |
| 2,395,745 | A | * | 2/1946 | King | 285/367 |
| 3,022,648 | A | * | 2/1962 | Thaler | 63/15 |
| 3,360,959 | A | * | 1/1968 | Schechter et al. | 63/15.6 |
| 3,380,263 | A | * | 4/1968 | Astor | 63/15.6 |
| 3,557,571 | A | * | 1/1971 | De Santo | 63/15.6 |
| 3,590,598 | A | * | 7/1971 | Leone | 63/15.6 |
| 3,901,045 | A | | 8/1975 | Ballester | |
| 4,043,145 | A | | 8/1977 | Chervin | |
| 4,215,556 | A | | 8/1980 | Mroz | |
| 4,245,485 | A | * | 1/1981 | Bushong | 63/15.6 |
| 4,317,264 | A | | 3/1982 | Bogner et al. | |
| 4,351,166 | A | | 9/1982 | Belin | |
| 4,538,430 | A | | 9/1985 | Parks | |
| 5,398,525 | A | * | 3/1995 | Kennedy | 63/28 |

(Continued)

FOREIGN PATENT DOCUMENTS

| | | |
|---|---|---|
| CH | 695205 | 1/2006 |
| GB | 2405345 | 3/2005 |

(Continued)

*Primary Examiner* — Abigail Morrell
(74) *Attorney, Agent, or Firm* — Andrews Kurth LLP

(57) ABSTRACT

A jewelry arrangement that is configured to fit on a finger. The arrangement can include a first jewelry portion and a second jewelry portion. The first jewelry portion may be attached to the inner surface of the second jewelry portion. The second jewelry portion may be positioned away from the user's skin. The first jewelry portion may contain at least one element which may contact a user's skin. In one exemplary embodiment, the elements are semi-cylindrical, rounded or arc-shaped. In an other exemplary embodiment, the elements are cylindrical. Another exemplary embodiment may contain a combination of different elements that together create a non-uniform surface. In yet another exemplary embodiment, there may be a ring crown attached to the second jewelry portion. This ring crown may also form part of the non-uniform surface created by the first jewelry portion.

32 Claims, 9 Drawing Sheets

(56) References Cited

U.S. PATENT DOCUMENTS

| | | | | | |
|---|---|---|---|---|---|
| D431,793 | S | * | 10/2000 | Ambar | D11/34 |
| D439,190 | S | | 3/2001 | Itzkowitz | |
| D451,045 | S | * | 11/2001 | Ambar | D11/26 |
| D451,424 | S | * | 12/2001 | Ambar | D11/34 |
| D453,486 | S | * | 2/2002 | Zillig | D11/38 |
| D460,926 | S | * | 7/2002 | Zillig | D11/26 |
| D478,170 | S | * | 8/2003 | Catlett | D24/143 |
| D489,022 | S | * | 4/2004 | Riggio | D11/38 |
| 6,748,764 | B1 | | 6/2004 | Roemer | |
| D513,712 | S | | 1/2006 | Koren | |
| D516,937 | S | * | 3/2006 | Aghjayan et al. | D11/35 |
| D522,902 | S | | 6/2006 | Kaplan | |
| D523,370 | S | | 6/2006 | Yurman | |
| D530,641 | S | | 10/2006 | Rota | |
| D542,692 | S | * | 5/2007 | Sabet | D11/34 |
| D542,693 | S | * | 5/2007 | Sabet | D11/34 |
| 7,350,377 | B2 | | 4/2008 | Kaplan | |
| 2004/0177647 | A1 | * | 9/2004 | Dennis | 63/29.1 |
| 2005/0268653 | A1 | * | 12/2005 | Kaplan | 63/15.7 |
| 2006/0144083 | A1 | | 7/2006 | Layton | |
| 2006/0254313 | A1 | | 11/2006 | Koren | |
| 2007/0137250 | A1 | * | 6/2007 | Kohl | 63/15.6 |

FOREIGN PATENT DOCUMENTS

| | | |
|---|---|---|
| JP | 2004154466 | 6/2004 |
| JP | 2004248843 | 9/2004 |
| JP | 2006167041 | 6/2006 |
| WO | 9621374 | 7/1996 |
| WO | 2006116425 | 11/2006 |

* cited by examiner

IRREGULAR FINGER RING CONFIGURATION

FIELD OF INVENTION

The present invention generally relates to jewelry arrangements, and particularly to exemplary ring arrangements.

BACKGROUND

Rings worn on user's fingers and on other portions of the user's body, such as engagement rings and wedding bands, may be made of precious or semi-precious metals, such as gold, silver or platinum, and can be fitted with a variety of precious gemstones, such as diamonds, rubies, emeralds, opals, etc. Generally, these rings have a pseudo-cylindrical or cylindrical shell or portion, the internal surface of which is shaped such that it can be easily placed/maintained on the wearer's finger. In order for the ring not to easily revolve around the finger, and thus possibly slip off the finger unintentionally, the ring can be fit in a snug manner. Another issue to be addressed is for the ring to fit snugly enough not to easily rotate on the finger, while still fitting around the knuckles of the finger. The common feature in many if not all fitted rings is to increase the pressure on the finger by slightly reducing or otherwise lessening the radial length or radius of the ring, thereby increasing the friction on the skin of the finger to have the ring maintained on the finger snuggly. Prior attempts to address these issues have led to a creation of rings fitted with inserts, clasps, and other ways of adjusting the size of the ring.

While making the above-described adjustments, it is also important to maintain an aesthetically pleasing appearance of the ring. Further, although the above-described inserts, clasps, etc. may facilitate the ring fitting snuggly on the user's finger, these additional elements may require additional effort by the user to actually fit the ring on a finger. In addition, the use of these additional elements may detract from the aesthetic features of the ring. It may be desirable to provide a jewelry arrangement, e.g., a ring that does not utilize additional elements or a reduction of the radial length/radius to be maintained snuggly on the finger, while functioning to resolve common fitting issues.

SUMMARY OF THE INVENTION

Thus, it is one of the objects of the present invention to overcome the above-described deficiencies, and provide exemplary embodiments of a jewelry arrangement according to the present invention. According to one exemplary embodiment of the present invention, a ring arrangement can be provided which has a first jewelry portion and a second jewelry portion. The first jewelry portion preferably is attached to the inner surface of the second jewelry portion in at least one place. The first jewelry portion preferably creates a non-uniform surface that may contact a ring wearer's skin. The first jewelry portion may include at least one element which has a shape that is different from the particular skin portion. These elements may be of varying sizes and shapes. Additionally, the second jewelry portion may contain a ring crown that may be a setting for a stone. This ring crown may also form part of the non-uniform surface in the first jewelry portion.

In a different exemplary embodiment, the first jewelry portion may have a plurality of sections which extend along for the full circumference of the finger of the user. In similar exemplary embodiments, the sections may extend along for at least a quarter, an eighth or half of the circumference of the finger. In a different exemplary embodiment, the first jewelry portion may have a shaped that looks like an cross, "W", "M", "U", or any other angle of such image.

In a different exemplary embodiment, the sections of the first jewelry portion may be connected by at least one end to the second jewelry portion. In some exemplary embodiments, the sections of second jewelry portion may contain more than one end which may be connected to the second jewelry portion or other sections of the first jewelry portion. The sections of the first jewelry portion may have a rounded, semi-circular, semi-cylindrical, or arc-shaped look, which may contact a portion of skin. In a different exemplary embodiment, the first and/or second jewelry portions may contain gemstones.

BRIEF DESCRIPTION OF THE DRAWINGS

The detailed description below will refer to the following illustrations, wherein like numerals refer to like elements, and wherein.

Figure 1:
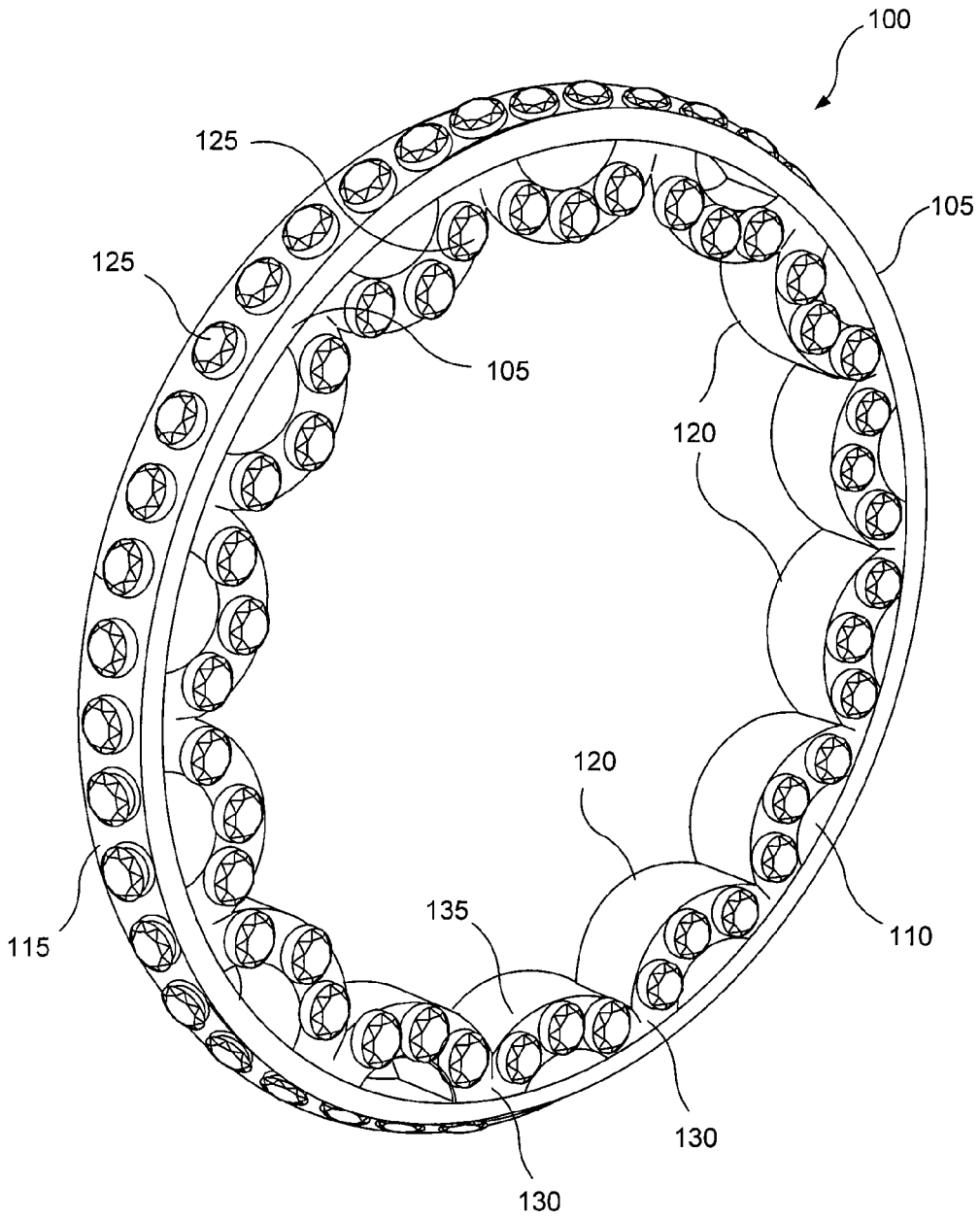
FIG. 1 is a perspective view of a first exemplary embodiment of a jewelry arrangement (e.g., ring arrangement) according to the present invention.
Figure 2A:
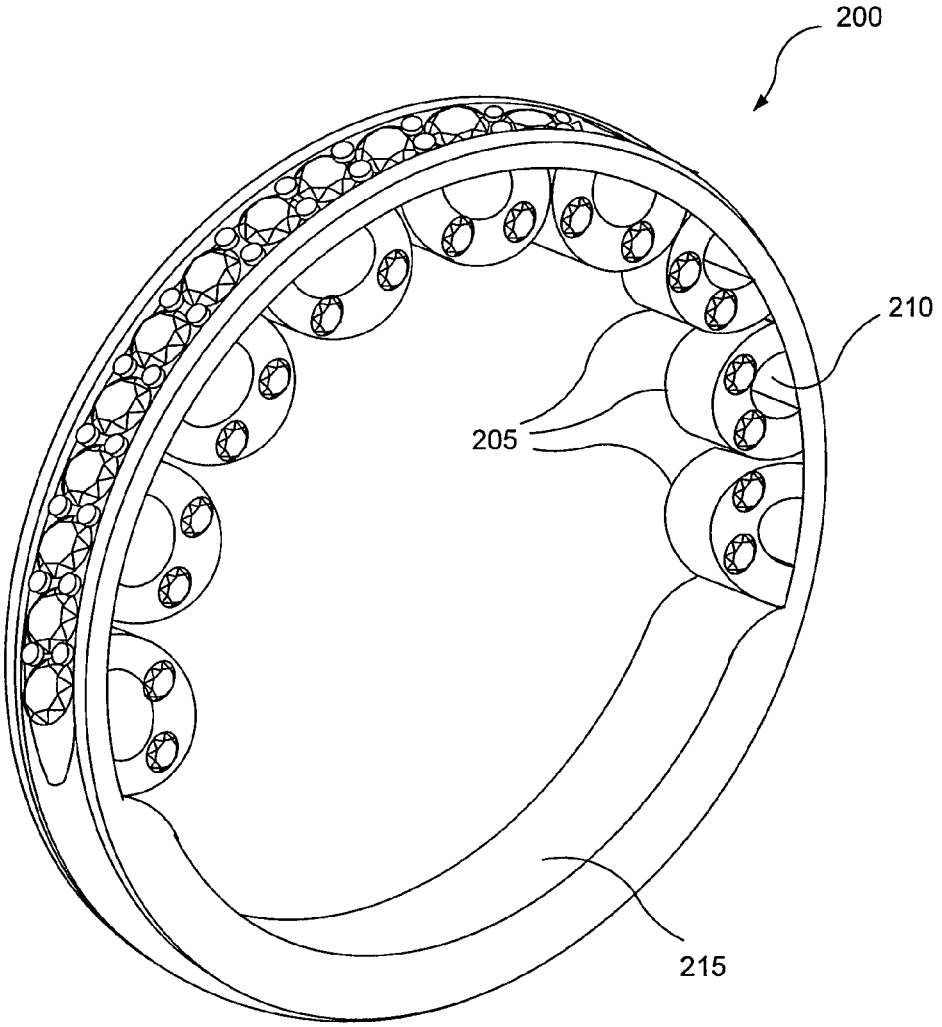
FIGS. 2A-2D are perspective views of certain exemplary variants of a second exemplary embodiment of a jewelry arrangement (e.g., ring arrangement) according to the present invention.
Figure 2B:
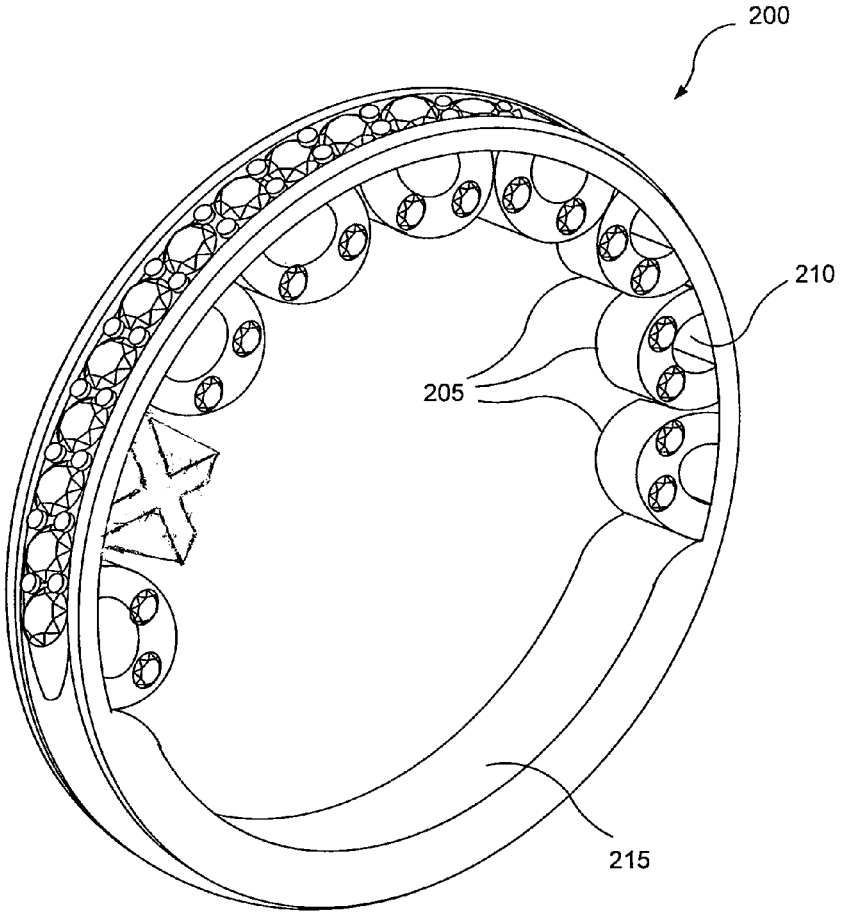
Figure 2C:
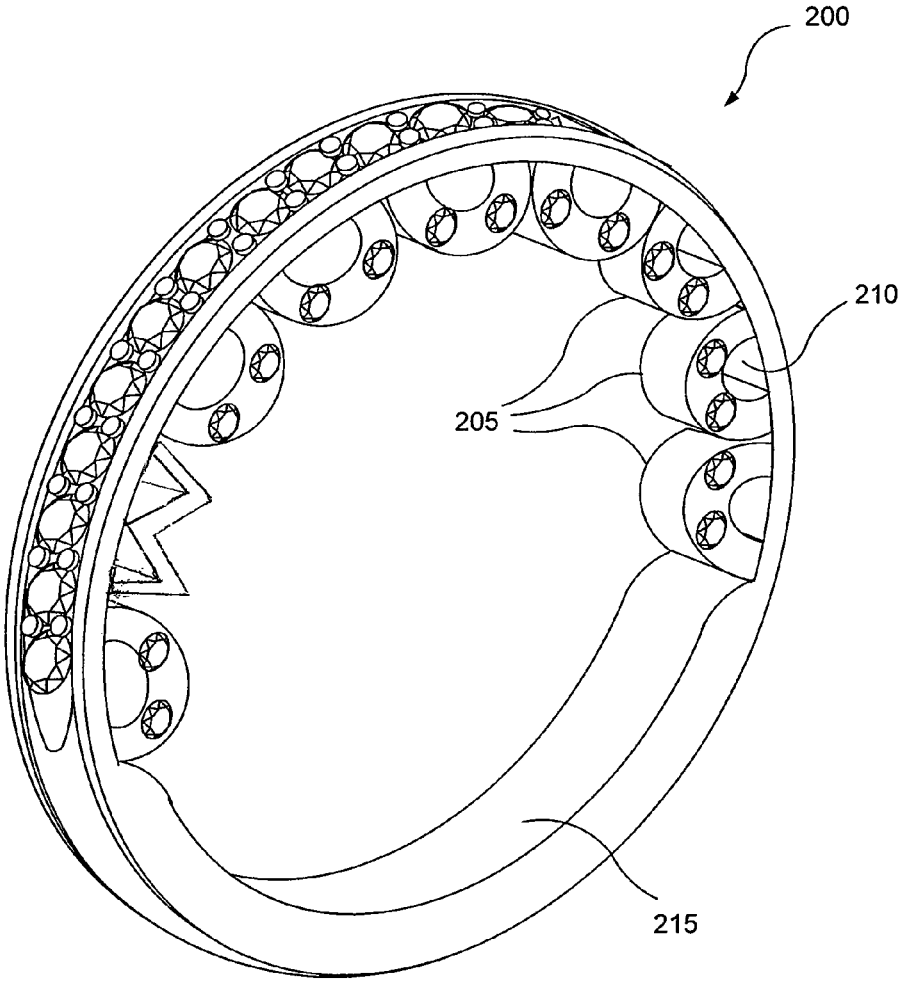
Figure 2D:
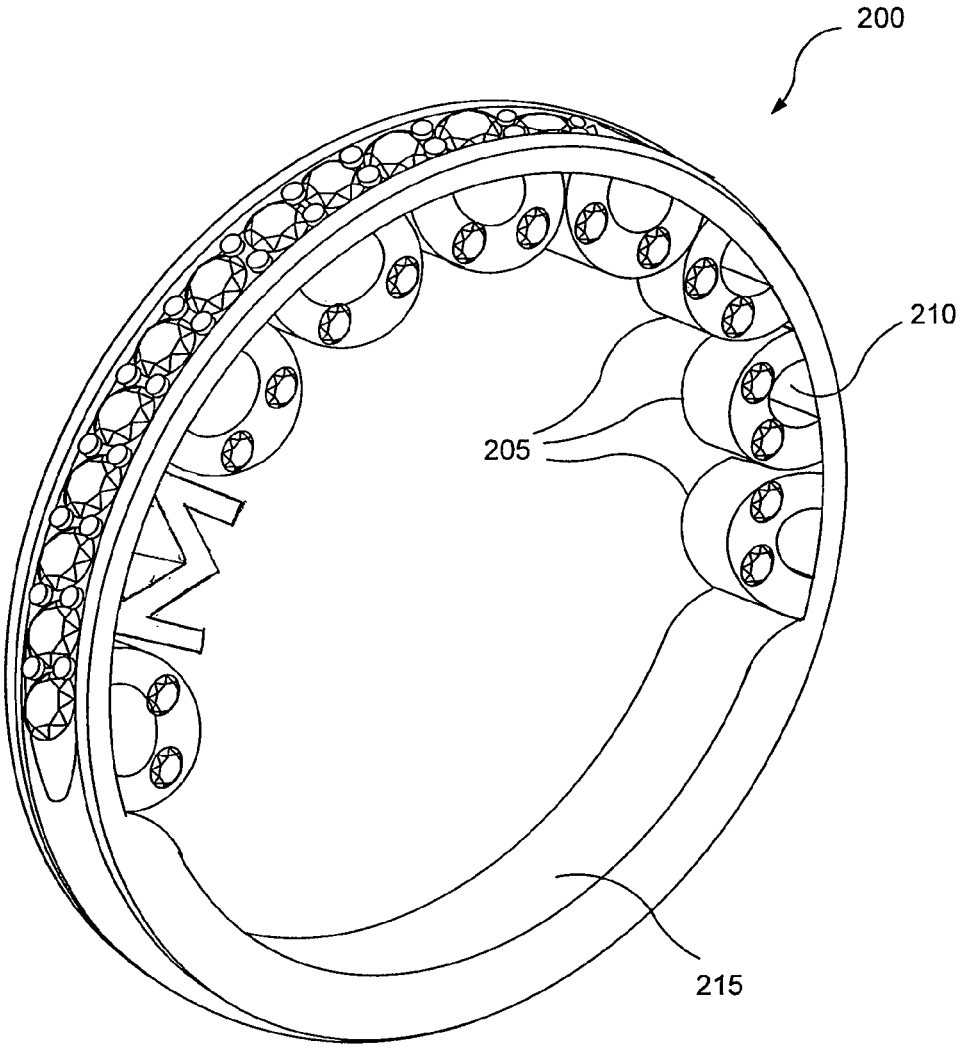

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described embodiments without departing from the true scope and spirit of the subject invention as defined by the appended claims.

DETAILED DESCRIPTION OF EXEMPLARY EMBODIMENTS

FIG. 1 shows a perspective view of a first exemplary embodiment of a jewelry arrangement 100 (e.g., a ring arrangement) according to the present invention. The configuration of jewelry arrangement 100 may improve the ring's rotational stability on the finger of the user by assisting with preventing rotation around the finger. The ring arrangement 100 of FIG. 1 may include a circular or cylindrical main ring band 105. The main ring band 105 can have an inner face 110 and an outer face 115. The inner face 110 can have thereon one or more semi-cylindrical, rounded or arc-shaped elements 120. These elements 120 can have ends 130 which can contact and/or are attached to the inner face 110 of the jewelry arrangement 100. The ends 130 of each of the elements 120 can be spaced apart. Each respective element 120 having the respective ends 130 includes a rounded portion 135 which connect the respective ends 130.

According to one exemplary variant, a single element 120 can be provided on the inner face of 110. In another variant, two or more of the elements 120 can be provided, spaced apart from one another, e.g., the respective ends 130 of each element 120 not contacting the respective ends 140 of any other of the elements 120 (e.g., for the entire inner face 110 or portion thereof), and none of the elements 120 overlap in a circumferential direction around jewelry arrangement 100. In still another variant, one of the respective ends 130 of at least one of the elements is immediately adjacent to and contacts one of the respective ends 130 of another element. Indeed, as shown in the first exemplary embodiment of FIG. 1, every one of the elements 120 contacts another one of the elements 120 along the inner face 110. It is also possible that such contacting of the elements occurs for a portion of the inner face 110 or portion thereof. The portions of the inner face 110 described above can be ⅛, ¼, ⅜, ⅝, ¾, any other ratio.

Unlike traditional rings having a uniform inner face surface which to a large extent conforms to a shape of a finger, the exemplary embodiment of the jewelry arrangement 100 may be fitted with at least one arc-shaped, rounded or semi-cylindrical elements 120 can provide a non-uniform surface which is intended to contact the skin of the finger fitted with such jewelry arrangement 100. By providing these exemplary inner semi-cylindrical or arc-shaped elements 120 on the inner face of 110, the jewelry arrangement 100 may better provide a snug fit on the user's finger. This snug fit may decrease the amount of rotation of the ring arrangement once on a finger, thereby reducing the unintentional slippage of the jewelry arrangement 100 on the finger, at least partially, and limiting a readjustment of the size of arrangement 100. Additionally, as provided in the first exemplary embodiment of the invention, shown in FIG. 1, the jewelry arrangement 100 may be adorned with precious or semi-precious gemstones 125.

FIG. 2 shows a perspective view of a second exemplary embodiment of the jewelry arrangement 200 according to the present invention. As shown in FIG. 2, the jewelry arrangement 200 also includes the semi-cylindrical, rounded or arc-shaped elements 205. However, these exemplary elements 205 contact adjacent elements 205, and may not extend along the entire inner face 210 of the jewelry arrangement 200. In addition to the elements 205, the exemplary jewelry arrangement 200 that is intended to at least partially contact the skin may be a combination of the uniform surface 215 (e.g., provided separately from the elements 205) which may have a rounded shape and be configured to contact the skin of the user of jewelry arrangement 200. Uniform surface 215 can define an interior of the ring jewelry arrangement. The complete side of the second exemplary embodiment of the jewelry arrangement 200 that may be a combination of the uniform surface 205 and at least one of the elements 205.

Figure 3:
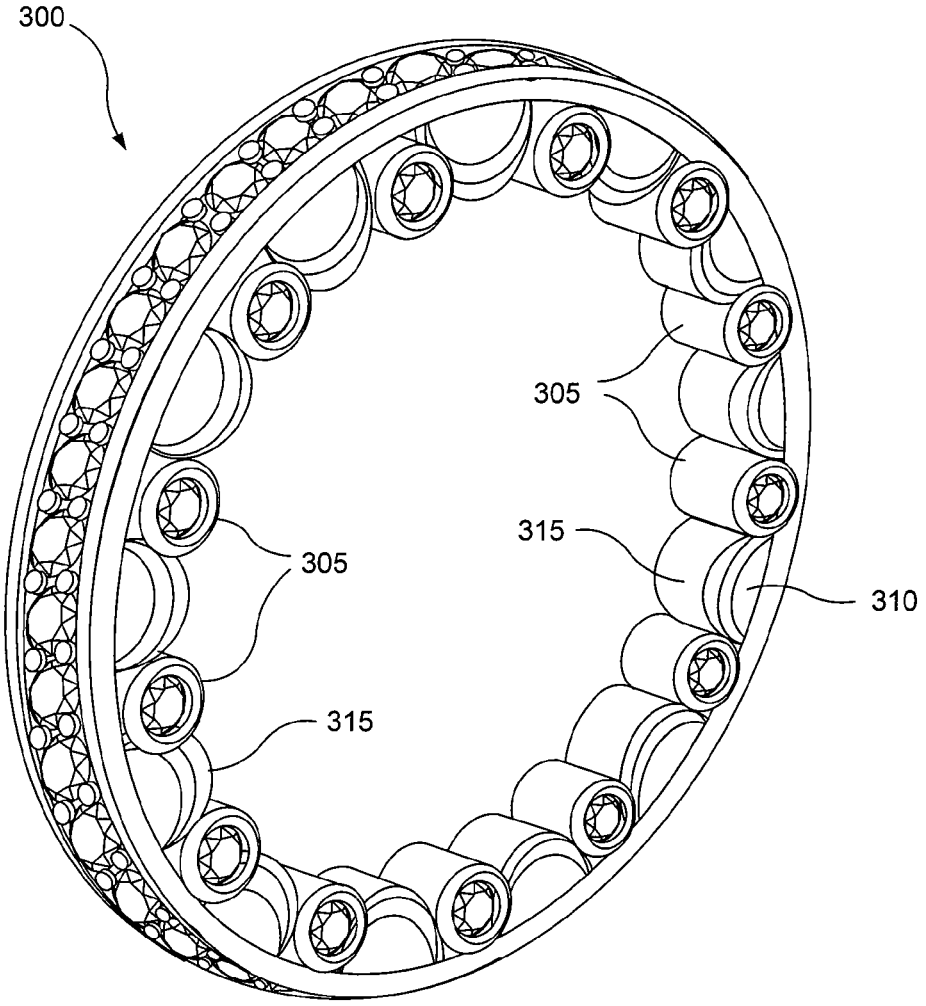
FIG. 3 is a perspective view of a third exemplary embodiment of a jewelry arrangement (e.g., ring arrangement) according to the present invention.

FIG. 3 shows a perspective of a third exemplary embodiment of the jewelry arrangement 300 of the present invention. The jewelry arrangement 300 may have cylindrical elements 305 attached to the inner surface 310 of the jewelry arrangement 300. The additional cylindrical elements 305 may be provided instead of or in addition to other elements attached to the inner surface 310, such as semi-cylindrical, rounded or arc-shaped elements 315. The addition of the cylindrical elements 305 may also facilitate a non-uniform surface on the side of the jewelry arrangement 300 intended to contact the skin of the user.

Figure 4:
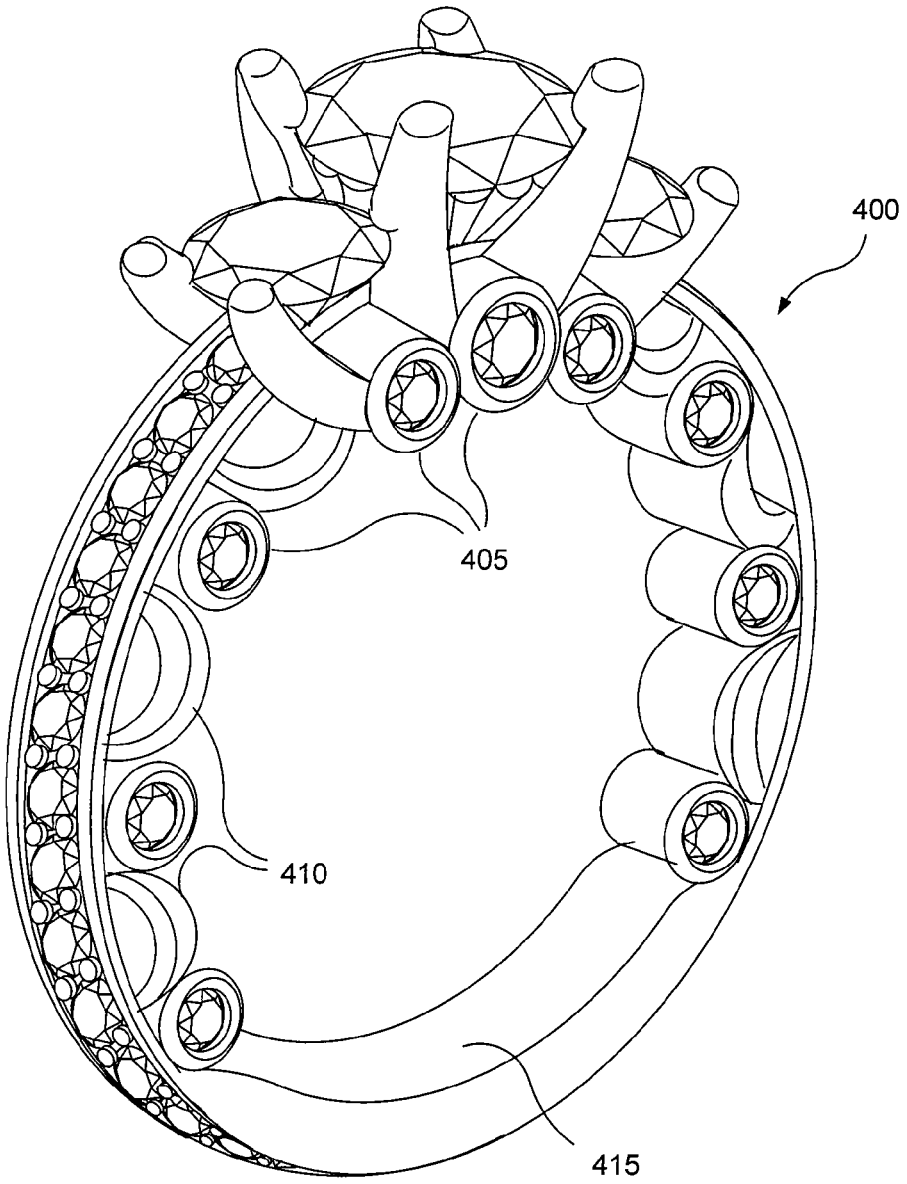
FIG. 4 is a perspective view of a fourth exemplary embodiment of a jewelry arrangement (e.g., ring arrangement) according to the present invention.

As shown in FIG. 4, the exemplary embodiment of the jewelry arrangement 400 may have cylindrical elements 405 of varying sizes that may be adjacent to one another or adjacent to a semi-cylindrical or arc-shaped element 410 or to a uniform surface 415 which is similar to the uniform surface 215 of FIG. 2. Similar to the semi-cylindrical, rounded or arc-shaped elements 410, the addition of the cylindrical elements 405 may reduce the amount of rotation of a fourth exemplary embodiment of the jewelry arrangement 400 once placed on the finger, thereby possibly reducing an adjustment of the radial length/radius of the jewelry arrangement 400.

Figure 5:
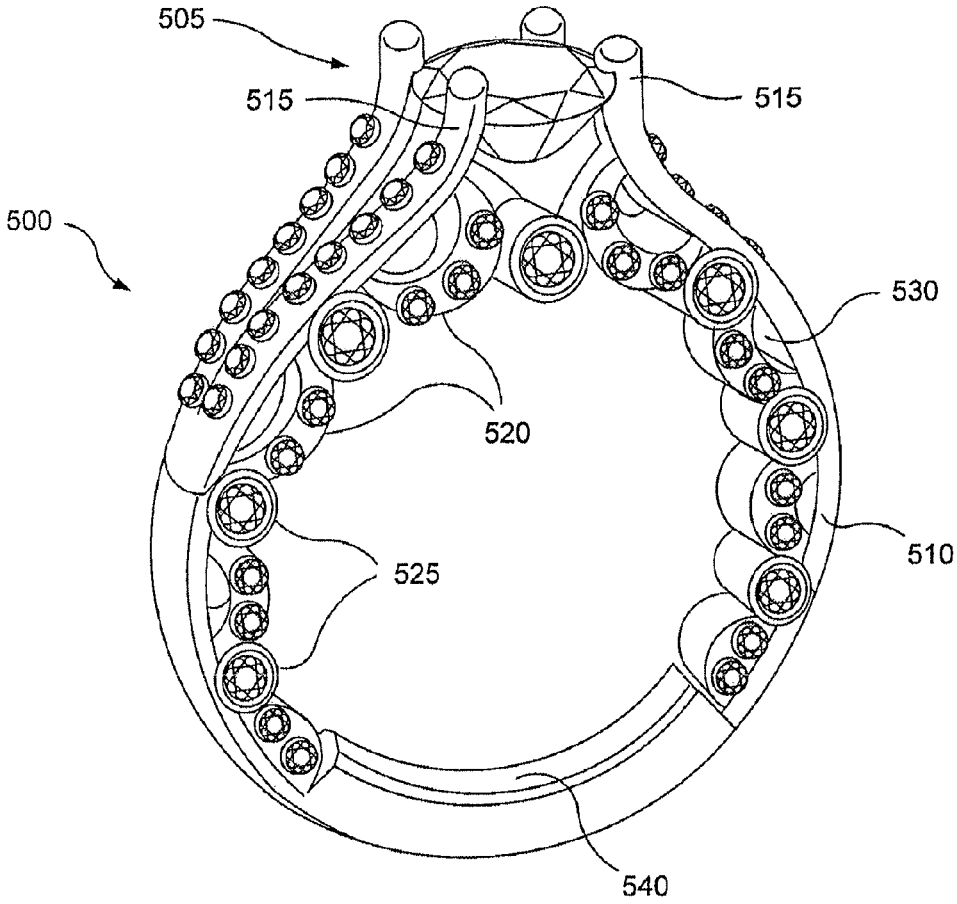
FIG. 5 is a perspective view of a fifth exemplary embodiment of a jewelry arrangement (e.g., ring arrangement) according to the present invention.
Figure 6:
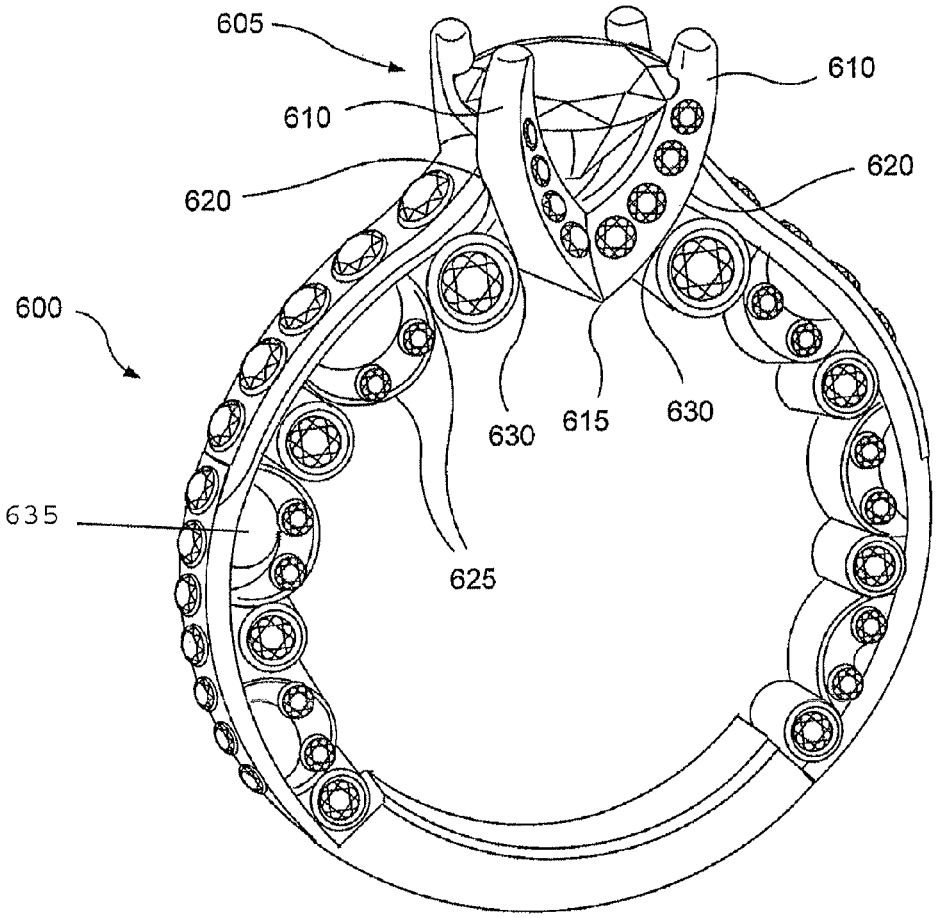
FIG. 6 is a perspective view of a sixth exemplary embodiment of a jewelry arrangement (e.g., ring arrangement) according to the present invention.

FIGS. 5 and 6 show fifth and sixth exemplary embodiments of the jewelry arrangements according to the present invention, which can include a crown. For example, FIG. 5 shows a fifth exemplary embodiment of the jewelry arrangement 500. The exemplary jewelry arrangement 500 can include a ring crown 505 that may be supported by a main ring band 510. Further, it is possible that the main ring band 510 may not form a completely cylinder or circle shape on its own, but may form a setting 515 for a gemstone, which may complete the cylinder or circle shape of the main ring band 510. Similar to the embodiments shown in FIGS. 1-4, the main ring band 510 may have at least one semi-cylindrical, rounded or arc-shaped element 520 and/or at least one cylindrical element 525.

The semi-cylindrical, rounded or arc-shaped and cylindrical elements 525 may be in a configuration to create a non-uniform surface which is intended to contact user's skin. Additionally, the semi-cylindrical, rounded or arc-shaped elements 520 and cylindrical elements 525 may be affixed to the inner surface 530 of the main ring band 510 or to other semi-cylindrical, rounded or arc-shaped elements 520 and/or the cylindrical elements 525. In addition to the semi-cylindrical, rounded or arc-shaped and cylindrical elements, the exemplary arrangement 500 may contain a uniform surface 540 which is intended to contact the skin of the user. The complete side of the exemplary jewelry arrangement 500 intended to contact the skin of the user may be a combination of the inner surface of the main ring and at least one of the semi-cylindrical, rounded elements 520 and/or the cylindrical elements 525.

FIG. 6 illustrates a sixth exemplary embodiment of the jewelry arrangement 600 of the present invention. The exemplary jewelry arrangement 600 of FIG. 6 can have a ring crown 605 and a setting 610 which may also form a part of the surface 615 which is intended to contact the skin of the user. The jewelry setting 610 may be attached to a main ring band 620 and to at least one of the semi-cylindrical, rounded or arch-shaped 625 and the cylindrical elements 630, each of which can have a through-hole.

According to another exemplary embodiment of the present invention, the semi-cylindrical, rounded or arc-shaped elements can be provided on the jewelry arrangement such that the respective ends thereof are pointed toward the skin of the user, which the rounded portion between the respective ends is attached to the inner face/surface of the exemplary embodiment of the jewelry arrangement. In addition, other shapes of members attached to the inner face/surface which do not have a shape for approximately conforming to the shape of the user's finger on which the exemplary jewelry arrangement is to be placed. Such shapes include but no limited to "X", "M", "W" or others that are overlaid by an inner face/surface on a side opposite to the skin of the user, whereas exemplary variants of the second exemplary embodiment are shown in, e.g., FIGS. 2B-2D, respectively.

Although the present invention has been described with respect to particular embodiments thereof, variations are possible. The present invention may be embodied in specific forms without departing from the essential sprit or attributes thereof. For example, although the present invention is illustrated with embodiments having semi-cylindrical or arc-shaped and cylindrical elements to create non-uniform surfaces, one skilled in the art will recognize that other embodiments may use which have various geometries (such as hexagonal, oval, or tear-drops) that still create a non-uniform surface which may contact a ring wearer's skin. It is desired that the embodiments described herein be considered in all respect illustrative and not restrictive and that reference be made to the appended claims and their equivalents for determining the scope of the invention.

What is claimed is:

1. A ring jewelry arrangement, comprising:

a plurality of rigid first jewelry finger ring portions; and at least one second jewelry finger ring portion positioned at a distance from a center of the ring jewelry arrangement that is further than a distance from the first jewelry finger ring portions to the center of the ring jewelry arrangement, the at least one second jewelry finger ring portion being directly and permanently connected to the first jewelry finger ring portions, wherein at least one through hole is provided between at least one of the first jewelry finger ring portions and the at least one second jewelry finger ring portion, and wherein each of the first jewelry finger ring portions has an outermost surface provided closest to the center of the ring jewelry arrangement to define an interior of the ring jewelry arrangement disposed to contact a finger received in the ring jewelry arrangement, the outermost surface curving away from the center of the ring jewelry arrangement and in a direction toward the at least one second jewelry finger ring portion, and wherein the first jewelry finger ring portions do not overlap in a circumferential direction about the at least one second jewelry finger ring portion;

wherein the at least one of the first jewelry finger ring portions has a first surface that forms at least one first section of the at least one through hole and the at least one second jewelry finger ring portion has a second surface that forms at least one second section of the at least one through hole, the first surface being situated opposite to the second surface, and wherein a curvature of the first surface is different than a curvature of the second surface.

2. The arrangement of claim 1, wherein the first jewelry finger ring portions extend along for at least half of a circumference of the at least one second jewelry finger ring portion.

3. The arrangement of claim 1, wherein the first jewelry finger ring portions extend along for at least a quarter of a circumference of the at least one second jewelry finger ring portion.

4. The arrangement of claim 1, wherein the first jewelry finger ring portions extend along an entire circumference of the at least one second jewelry finger ring portion.

5. The arrangement of claim 1, wherein the at least one of the first jewelry finger ring portions has at least two ends connected to one another at outermost edges thereof by the at least one second jewelry finger ring portion, and wherein each of the ends points away and opposite from the center of the ring jewelry arrangement.

6. The arrangement of claim 5, wherein the first jewelry finger ring portions further comprise at least one cylindrical element, wherein at least one hole is provided between the at least one cylindrical element and at least one of the ends, and wherein the at least one cylindrical element has an outer substantially uniform surface.

7. The arrangement of claim 5, wherein each of the ends have outermost edges which immovably connect each of the at least one first jewelry finger ring portions to the at least one second jewelry finger ring portion.

8. The arrangement of claim 5, wherein the ends are permanently and directly connected to the at least one second jewelry portion.

9. The arrangement of claim 1, where the at least one of the first jewelry finger ring portions has a shape of at least one symbol of "X", "W", "M", "U", or inverted symbols thereof.

10. The arrangement of claim 1, wherein the at least one second jewelry finger ring portion includes a plurality of second jewelry finger ring portions, each covering the respective first jewelry finger ring portion.

11. The arrangement of claim 1, wherein the at least one of the first jewelry finger ring portions comprises at least one semi-cylindrical element.

12. The arrangement of claim 1, wherein the at least one of the first jewelry finger ring portions comprises at least one arc-shaped element.

13. The arrangement of claim 1, wherein the first jewelry finger ring portions comprise at least one cylindrical element having an outer substantially uniform surface.

14. The arrangement of claim 13, wherein the at least one first jewelry finger ring portions comprise at least two cylindrical elements, and wherein the at least one hole is provided between the at least two cylindrical elements and the at least one second jewelry finger ring portion.

15. The arrangement of claim 1, wherein the at least one second jewelry finger ring portion includes at least one ring crown element which forms a part of a surface of the at least one second jewelry finger ring portion.

16. The arrangement of claim 1, wherein the at least one second jewelry finger ring portion is integral with the first jewelry finger ring portions.

17. The arrangement of claim 1, wherein the at least one through hole extends entirely through the arrangement in a direction approximately perpendicular to a plane extending from the at least one second jewelry finger ring portion towards the center.

18. The arrangement of claim 1, wherein each of the first jewelry finger ring portions includes an inner-most edge of the arrangement with respect to a location of the center of the ring jewelry arrangement.

19. The arrangement of claim 1, wherein at least two of the first jewelry finger ring portions are provided immediately adjacent to one another.

20. The arrangement of claim 19, wherein the at least one through hole extends in a direction which is approximately perpendicular to a plane extending from the at least one second jewelry finger ring portion towards the center.

21. The arrangement of claim 1, wherein ends of the outermost surfaces of at least two adjacent portions of the first jewelry finger ring portions form a "V" at a contact point thereof.

22. The arrangement of claim 1, wherein at least one end of the at least one of the first jewelry finger ring portions directly contacts another one of the first jewelry finger ring portions.

23. The ring jewelry arrangement of claim 1, wherein the at least one through hole extends generally axially with respect to the at least one second jewelry finger ring portion.

24. The ring jewelry arrangement of claim 1, further comprising at least one gemstone.

25. The ring jewelry arrangement of claim 1, wherein a curvature of the outermost surface of the at least one of the first jewelry finger ring portions is substantially the same as the curvature of the first surface of the at least one of the first jewelry finger ring portions.

26. A ring jewelry arrangement, comprising:

a plurality of rigid first jewelry finger ring portions; and at least one second jewelry finger ring portion positioned at a distance from a center of the ring jewelry arrangement that is further than a distance from the first jewelry finger ring portions to the center of the ring jewelry arrangement, the at least one second jewelry finger ring portion being directly and permanently connected to the first jewelry finger ring portions, wherein at least one through hole is provided between at least one of the first jewelry finger ring portions and the at least one second jewelry finger ring portion, wherein the at least one of the first jewelry finger ring portions has a "U" shape, and wherein the at least one of the first jewelry finger ring portions has an outermost surface provided closest to the center of the ring jewelry arrangement, the outermost surface having ends which are pointed away from the center of the ring jewelry arrangement and in a direction toward the at least one second jewelry finger ring portion, and the first jewelry finger ring portions do not overlap in a circumferential direction about the at least one second jewelry finger ring portion;

wherein the at least one of the first jewelry finger ring portions has a first surface that forms at least one first section of the at least one through hole and the at least one second jewelry finger ring portion has a second surface that forms at least one second section of the at least one through hole, the first surface being situated opposite to the second surface, and wherein a curvature of the first surface is different than a curvature of the second surface.

27. The arrangement of claim 26, wherein at least two of the first jewelry finger ring portions are provided immediately adjacent to one another.

28. The arrangement of claim 27, wherein the at least one through hole extends in a direction which is approximately perpendicular to a plane extending from the at least one second jewelry finger ring portion towards the center.

29. The arrangement of claim 26, wherein the ends are permanently and directly connected to the at least one second jewelry portion.

30. The arrangement of claim 26, wherein at least one of the ends of one of the first jewelry finger ring portions directly contacts another one of the first jewelry finger ring portions.

31. The ring jewelry arrangement of claim 26, wherein a first curvature of the outermost surface of the at least one of the first jewelry finger ring portions is substantially the same as the curvature of the first surface of the at least one of the first jewelry finger ring portions.

32. The ring jewelry arrangement of claim 26, further comprising at least one gemstone.

* * * * *